US005785507A

United States Patent [19]

Hanneken

[11] Patent Number: 5,785,507

[45] Date of Patent: Jul. 28, 1998

[54] EVAPORATIVE COOLER PUMP

[75] Inventor: John B. Hanneken, Tempe, Ariz.

[73] Assignee: Dial Manufacturing, Inc., Phoenix, Ariz.

[21] Appl. No.: 308,145

[22] Filed: Sep. 19, 1994

[51] Int. Cl.[6] ..... F04B 17/03; F01D 25/24

[52] U.S. Cl. ..... 417/423.14; 417/238; 417/423.12; 415/912; 415/214.1

[58] Field of Search ..... 417/423.1, 423.3, 417/238.36, 423.14, 424.1; 415/113, 214.1, 216.1, 912

[56] References Cited

U.S. PATENT DOCUMENTS

| | | | |
|---|---|---|---|
| 2,256,527 | 10/1941 | Warman | 415/113 |
| 2,952,213 | 9/1960 | Goettl | 417/424.1 |
| 2,978,988 | 4/1961 | McAlpine | 417/423.14 |
| 3,227,087 | 1/1966 | Albee | 415/214.1 |
| 3,260,442 | 7/1966 | Laing | 415/214.1 |
| 3,748,066 | 7/1973 | Sully et al. | 417/423.3 |
| 3,841,791 | 10/1974 | Doolin | 415/912 |
| 3,861,831 | 1/1975 | Rule | 417/423.14 |
| 3,969,043 | 7/1976 | Bright et al. | 417/423.12 |
| 4,008,652 | 2/1977 | Baus | 415/147 |
| 4,466,780 | 8/1984 | Naurath | 417/423.14 |
| 4,688,293 | 8/1987 | McCambridge | 15/327 D |
| 4,767,277 | 8/1988 | Buse | 416/241 A |
| 4,806,083 | 2/1989 | LaGrange et al. | 417/423.14 |
| 5,058,557 | 10/1991 | Frank et al. | 417/423.3 |
| 5,145,337 | 9/1992 | Kirkland | 417/423.14 |

*Primary Examiner*—Timothy Thorpe
*Assistant Examiner*—Peter G. Korytnyk
*Attorney, Agent, or Firm*—Tod R. Nissle, P.C.

[57] ABSTRACT

An evaporative cooler pump is modularized to readily receive pump impellers and pump volutes of different shapes and dimensions in order to optimize the evaporative cooler water pump performance. The flow of water through the pump is streamlined to improve the efficiency of the pump.

12 Claims, 10 Drawing Sheets

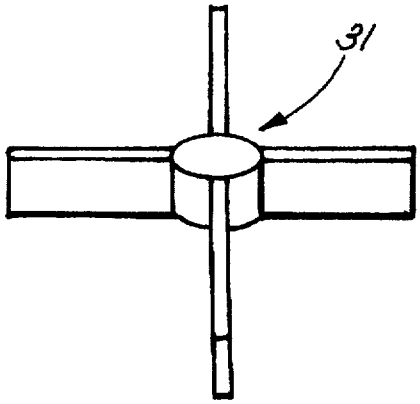
FIG. 1: PRIOR ART
FIG. 2: PRIOR ART
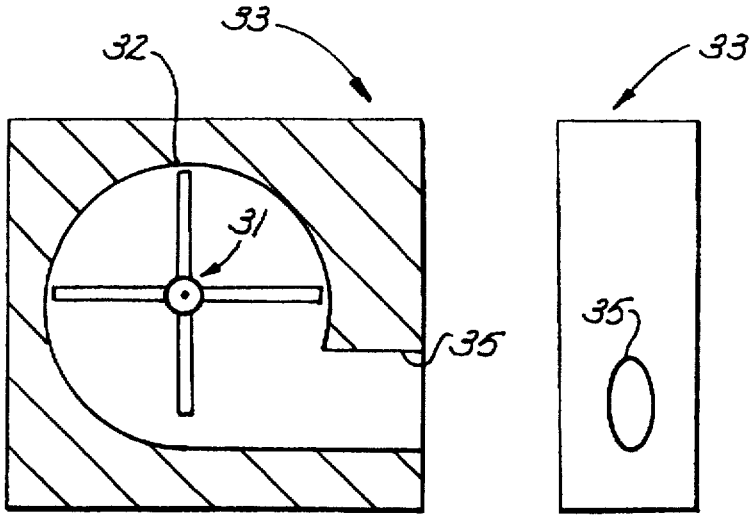

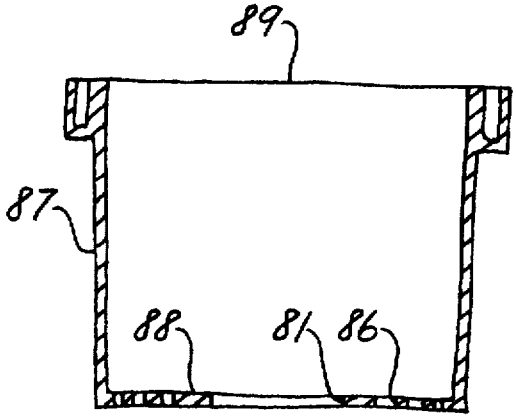
FIG. 19
FIG. 20
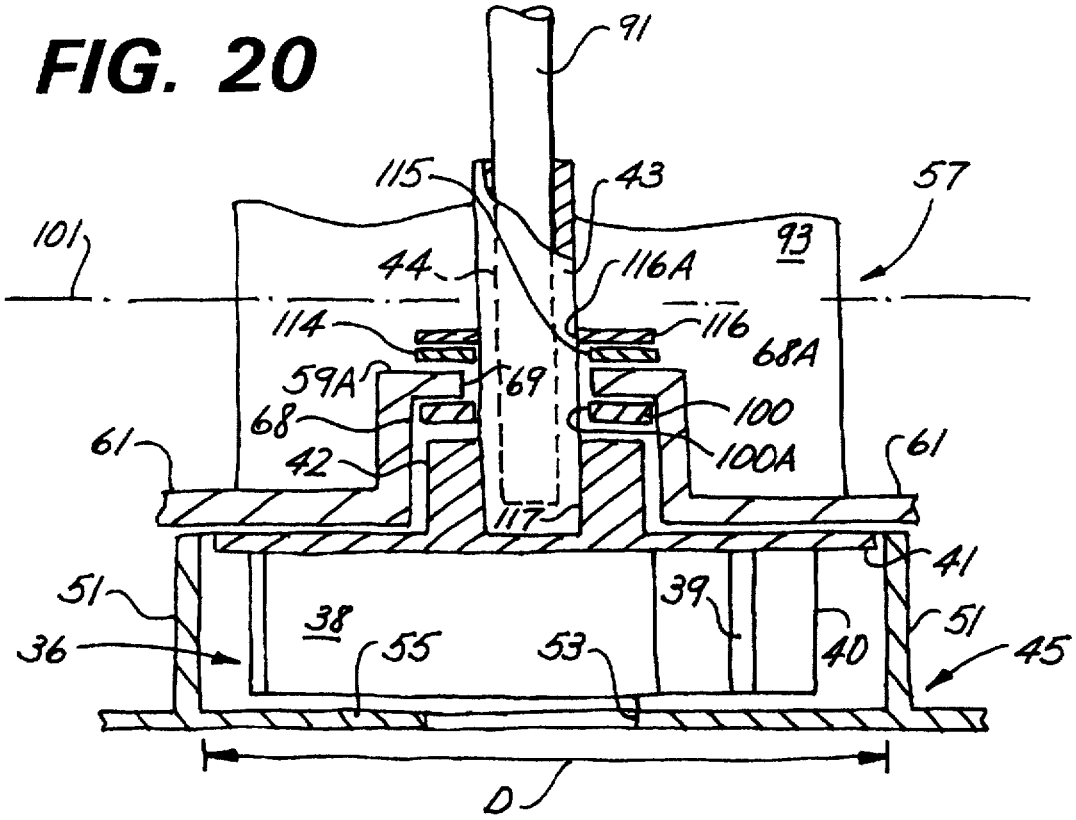

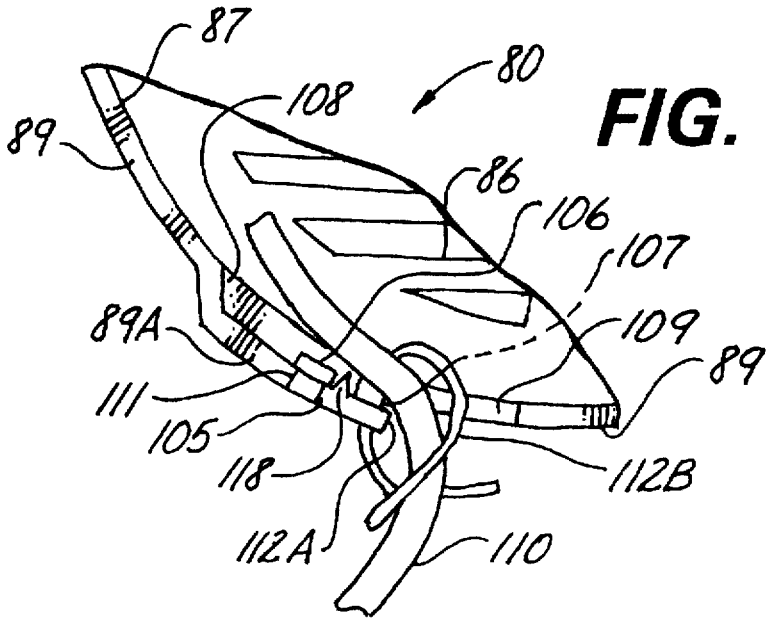
FIG. 22
FIG. 23
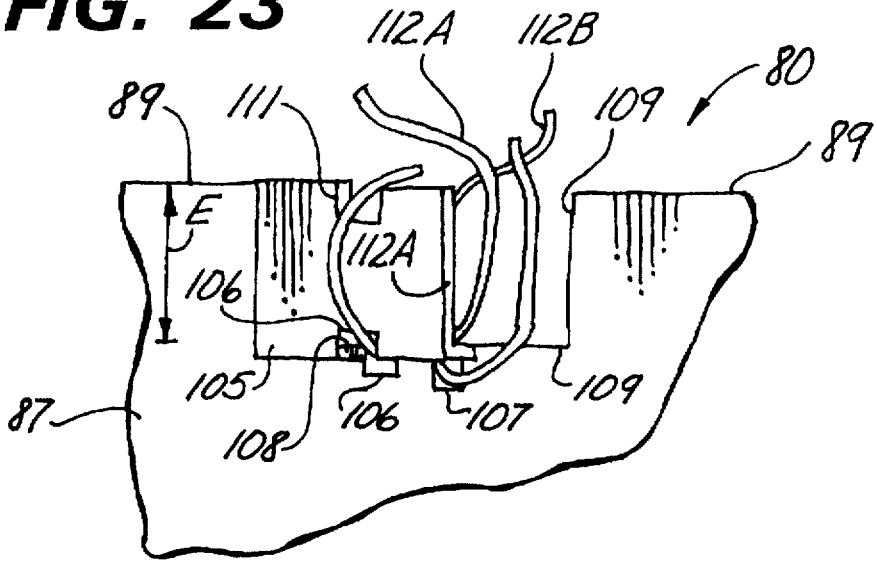

EVAPORATIVE COOLER PUMP

BACKGROUND OF THE INVENTION

1. Field of the Invention

This invention relates to evaporative cooler water pumps.

More particularly, the invention relates to an evaporative cooler pump which is more efficient than prior art pumps and which reduces the induced electrical current that flows from the electric motor through the motor's shaft and to the ground of the evaporative cooler.

In a further respect, the invention relates to an evaporative cooler pump which is modularized to readily receive pump impellers and pump volutes of different shapes and dimensions in order to optimize the evaporative cooler water pump performance.

2. Description of the Prior Art

The electric motors used to operate water pumps utilized in evaporative coolers ordinarily are two pole, shaded pole subfractional horsepower induction motors in the range of 1/150 horsepower to 1/20 horsepower. While such motors consume small amounts of energy in comparison to the larger motors used to operate standard air conditioning refrigeration units, improving the efficiency of operation of such an evaporative cooler water pump would permit an even smaller subfractional horsepower motor to be substituted for its larger subfractional horsepower motor, thus reducing motor costs and reducing the pump's electrical consumption.

Accordingly, it would be highly desirable to provide an improved and more efficient evaporative cooler pump which additionally reduces the electrical consumption of its conventional motors and which could be utilized to house different sized pump motors, pump impellers, and pump volutes.

Therefore, it is a principal object of the invention to provide an improved water pump for an evaporative cooler.

A further object of the invention is to provide an improved evaporative cooler water pump which is modularize to readily receive different sized pump motors, pump impellers and pump volutes of different shapes and dimensions, all in order to optimize the evaporative cooler water pump performance.

Another object of the invention is to improve the efficiency of conventional evaporative cooler water pumps up to twenty to twenty-five percent.

BRIEF DESCRIPTION OF THE DRAWINGS

These and other, further and more specific objects and advantages of the invention will be apparent to those skilled in the art from the following detailed description thereof, taken in conjunction with the drawings, in which:

FIG. 1 is a perspective view illustrating a conventional evaporative cooler water pump impeller;

FIG. 2 is a top view illustrating a conventional pump volute housing for the water pump impeller of FIG. 1;

FIG. 19 is a section view illustrating the pump can of FIG. 17 taken along section line 19—19;

FIG. 20 is a section view illustrating the pump body of FIG. 11, pump volute housing of FIG. 5, and pump impeller of FIG. 4 after they are assembled;

FIG. 22 is a top view illustrating an alternate embodiment of the portion of the pump can used to secure the power cord extending from a motor mounted in the pump can; and, FIG. 23 is a side view of the embodiment of the invention illustrated in FIG. 22.

SUMMARY OF THE INVENTION

Figure 3:
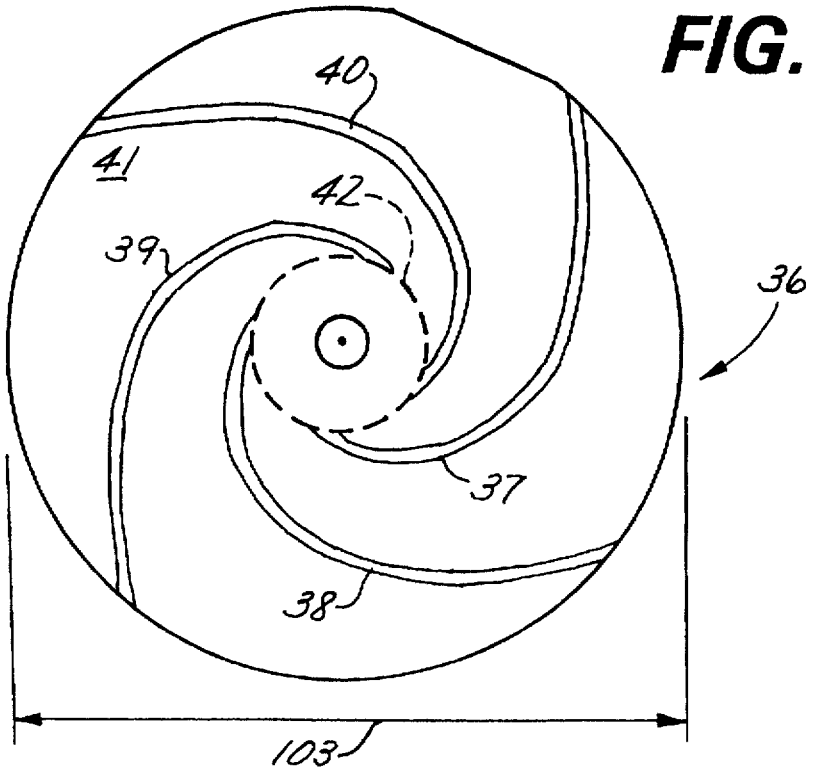
FIG. 3 is a bottom view illustrating an evaporative cooler water pump impeller constructed in accordance with the principles of the invention.

Briefly, in accordance with my invention, I provide a water pump for an evaporative cooler including a sump. The pump includes a base; an impeller volute housing formed in the base and including a volute outlet including generally normal walls defining the outlet; an impeller mounted on the base inside the housing and including a drive shaft extending out of the housing, the impeller including arcuate volute blades, the impeller normally submerged in water in the sump of the evaporative cooler; and, a motor mounted on the base spaced apart from the impeller to turn the drive shaft and impeller.

In another embodiment of my invention, I provide a water pump kit for an evaporative cooler including a sump. The kit includes a base; a first impeller volute housing including a volute outlet; a second impeller volute housing including a volute outlet, said second volute being larger than said first volute, said first and second housings being shaped and dimensioned to be mounted on said base, said housings being normally submerged in water in the sump of the evaporative cooler when mounted on the base; a first impeller sized to fit the first housing and including a drive shaft extending upwardly out of the housing, the impeller including blades; a second impeller sized to fit the second housing and including a drive shaft extending out of the second housing, the second impeller including blades, the second impeller being larger than the first impeller, the first and second impellers being shaped and dimensioned to be mounted on the base; and, a motor mounted on the base spaced apart from the impeller to turn the drive shaft the impeller mounted in the base, whether it be the first or the second impeller.

In a further embodiment of the invention, I provide a water pump for an evaporative cooler including a sump. The pump includes a base including an arcuate water outlet; an impeller volute housing in the base and including a volute outlet including generally normal walls defining the volute outlet; an impeller mounted on the base inside the housing and including a drive shaft extending out of the housing, the impeller including arcuate volute blades; a motor mounted on the base spaced apart from the impeller and operatively associated with the drive shaft to turn the drive shaft and impeller; and, a transition conduit interconnecting the volute outlet and the water outlet in the base, the transition conduit including an arcuate floor displacing water from the volute outlet into the water outlet in the base.

In still a further embodiment of my invention, I provide a water pump for an evaporative cooler including a sump. The water pump includes a base; an impeller volute housing in the base and including a volute outlet including generally normal walls defining the outlet; an impeller mounted on the base inside the housing and including a control shaft extending out of the housing, the impeller including arcuate volute blades, the impeller normally submerged in water in the sump of the evaporative cooler, the control shaft extending above water in the sump and being fabricated from an electrically insulative material; a motor mounted on the base spaced apart from the impeller to turn the control shaft and impeller.

DESCRIPTION OF THE PREFERRED EMBODIMENTS

Turning now to the drawings, which depict the presently preferred embodiments of the invention for the purpose of illustrating the practice thereof and not by way of limitation of the scope of the invention, and in which like reference characters represent corresponding elements throughout the several views, FIG. 1 illustrates a prior art impeller 31 including four elongate straight vanes spaced apart at ninety degree intervals. In FIG. 2 the impeller of FIG. 1 is rotatably mounted in a cylindrical opening 32 of a volute housing 33 with the center point of the impeller lying on the centerline of the cylindrical opening. The volute housing 33 includes an arcuate volute outlet 35 through which impeller 31 pumps water when impeller 31 turns in opening 32.

Figure 4:
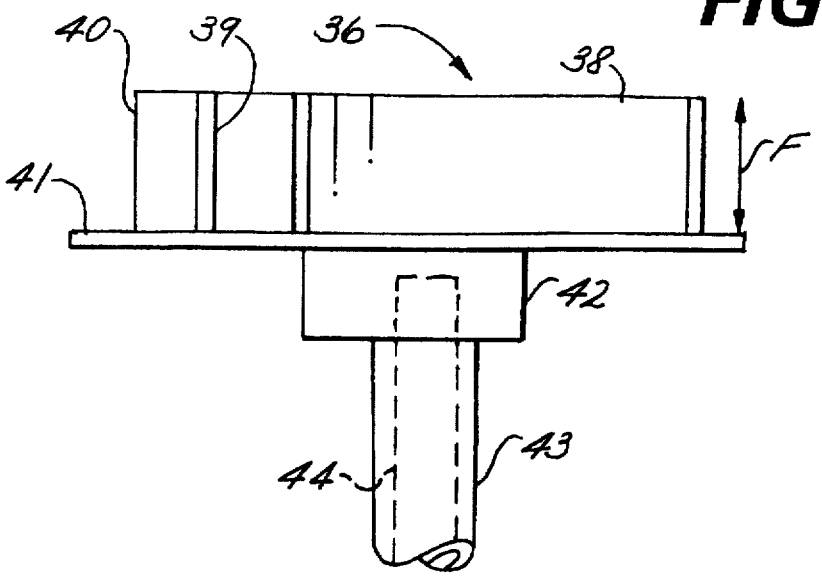
FIG. 4 is a side view illustrating the evaporative cooler water pump impeller of FIG. 3.
Figure 5:
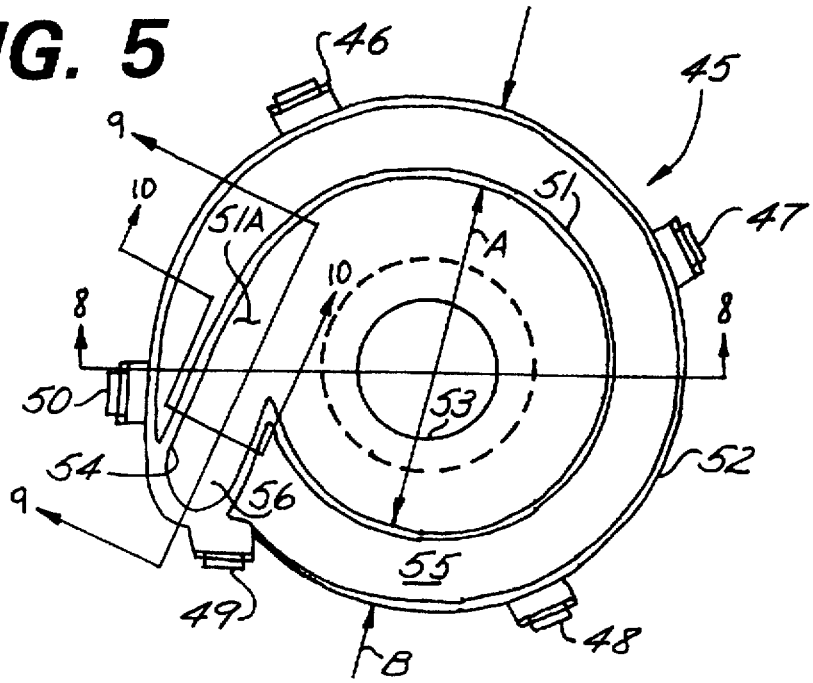
FIG. 5 is a top view illustrating a pump volute housing for the pump impeller of FIG. 3.
Figure 6:
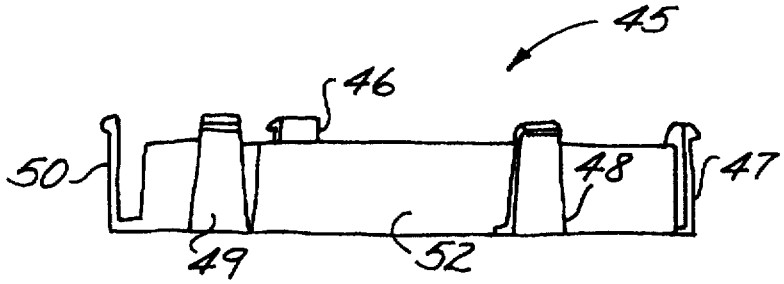
FIG. 6 is a side view illustrating the pump volute housing of FIG. 5.
Figure 7:
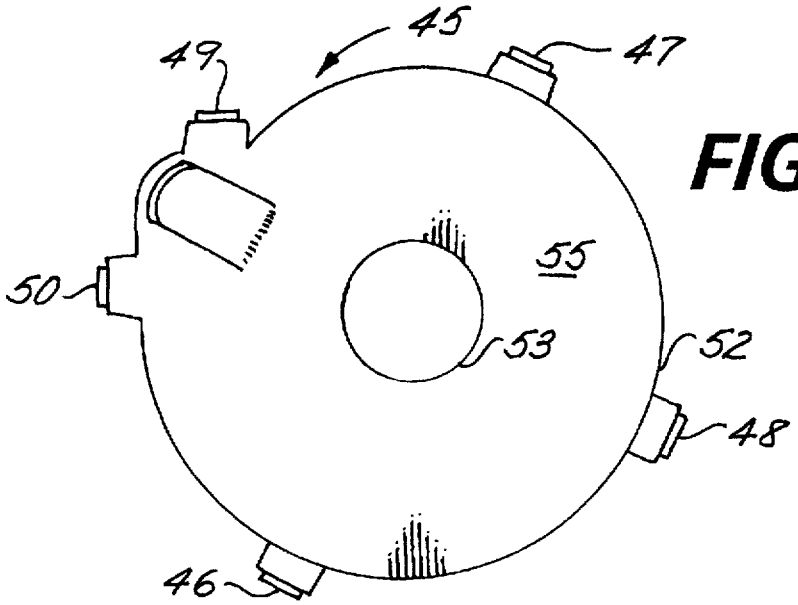
FIG. 7 is a bottom view illustrating the pump volute housing of FIG. 5.
Figure 8:
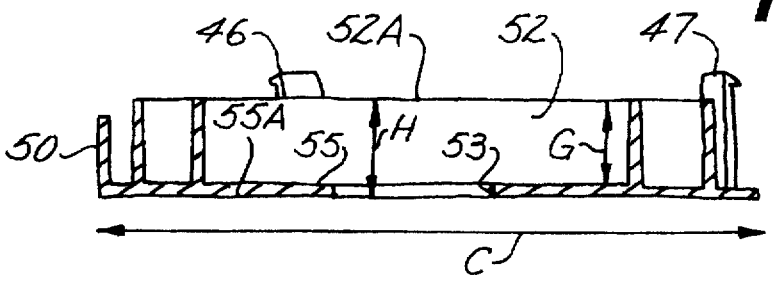
FIG. 8 is a section view further illustrating the pump volute housing of FIG. 5 and taken along section line 8—8 thereof.
Figure 9:
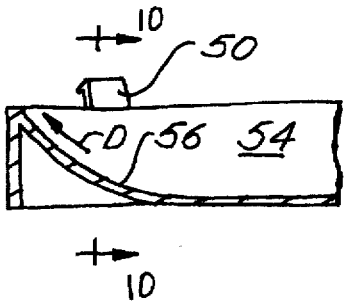
FIG. 9 is a section view further illustrating the pump volute housing of FIG. 5 and taken along section line 9—9 thereof.
Figure 10:
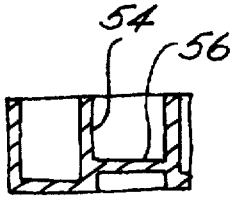
FIG. 10 is a section view further illustrating the pump volute housing of FIG. 5 and taken along section line 10—10 thereof.

FIGS. 3 and 4 illustrate the impeller 36 used in the evaporative cooler water pump of the invention. Impeller 36 includes circular plate 41. Arcuate volute ribs or blades 37 to 40 are mounted on, normal to, and outwardly extend from front or face of plate 41. Cylindrical hub 42 is attached to the back of plate 41 and fixedly receives motor shaft 43. Cylindrical aperture 44 formed in shaft 43 receives the drive shaft of a motor 93 mounted in the pump housing above impeller 36.

Figure 11:
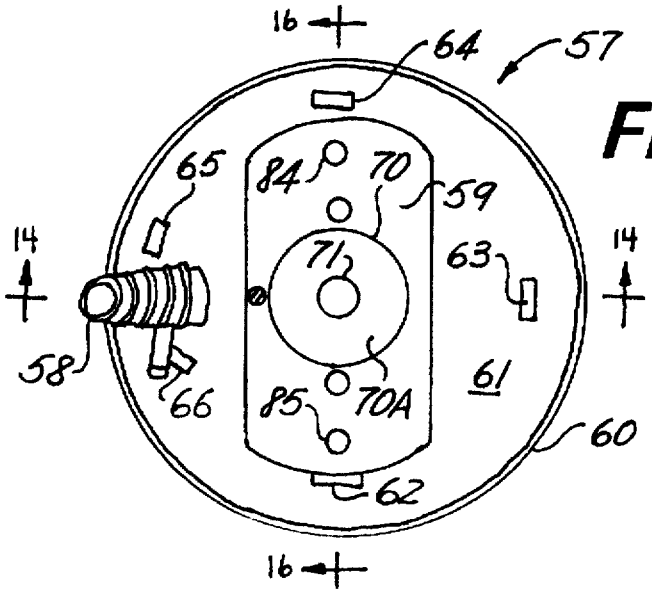
FIG. 11 is a top view illustrating the pump body or base which receives the pump impeller of FIG. 3 and the pump volute housing of FIG. 5.
Figure 12:
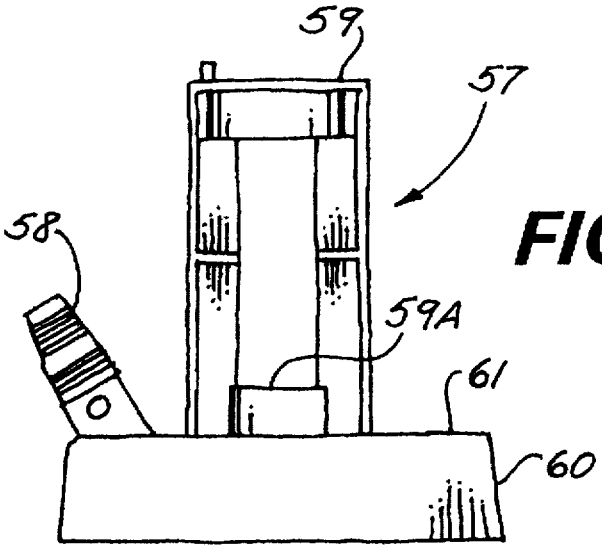
FIG. 12 is a side view illustrating the pump body or base of FIG. 11.

The pump volute housing 45 for impeller 36 is illustrated in FIGS. 5 to 10 and includes bottom surface 55 with water inlet aperture 53 formed therethrough. Arcuate side wall 52 extends upwardly from surface 55. Snaps 46 to 50 are attached to the bottom of wall 52 and extending upwardly. Volute side wall 51 is attached to, normal to, and extends upwardly from surface 55. Wall 51 houses impeller 36 when, as will be described, housing 45 is snapped into pump body or base 57 (FIG. 11). When pump volute housing 45 is snapped into pump body or base 57, the volute outlet 51A is rectangular, with housing 45 forming three sides of the rectangle and a portion of the top 61 of pump body 57 forming the fourth side of the rectangle. A conduit interconnects outlet 51A with the oval arcuate outlet 67 (FIG. 13) formed in the top 61 of pump body 57. This conduit is better seen in FIGS. 9 and 10 and includes an arcuate surface or ramp 56 with directs water from outlet 51A upwardly into outlet 67. Upstanding wall 54 is normal to surface 55.

The pump body or base 57 is illustrated in FIGS. 11 to 16, and includes top 61 connected to circular side wall 60. Arcuate outlet aperture 67 is formed through top 61 and is in fluid communication with ribbed nozzle 58 extending upwardly from top 61. A tower attached to and extending upwardly from top 61 includes wing or plate 59. Cylindrical opening 70 is formed in and extends downwardly from plate 59 to flat circular surface 70A. Circular aperture 71 is formed through surface 70A. Rectangular apertures 62 to 66 are formed through top 61.

Figure 13:
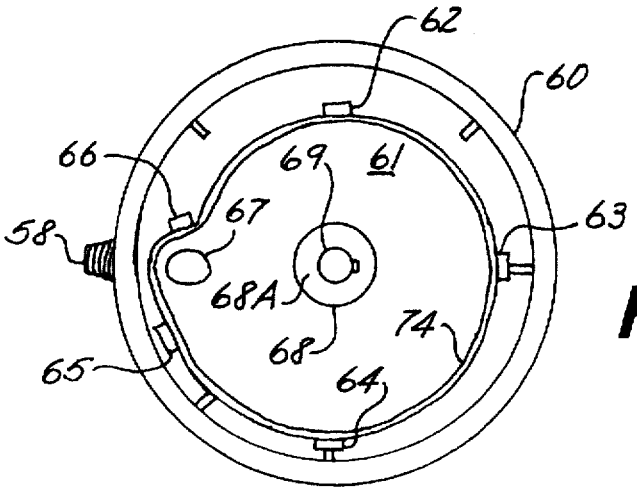
FIG. 13 is a bottom view illustrating the pump body of FIG. 11.
Figure 14:
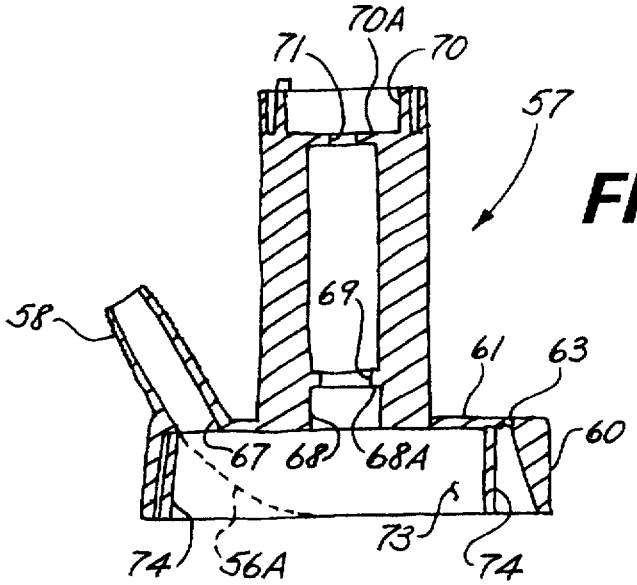
FIG. 14 is a section view of the pump body of FIG. 11 further illustrating construction details thereof and taken along section line 14—14.

In the bottom view of pump body or base 57 illustrated in FIG. 13, the volute-shaped wall 74 is attached to, normal to, and extends outwardly from top 61. Cylindrical aperture 68 is formed through top 61 and extends upwardly to circular surface 68A. Circular aperture 69 is formed through surface 68A. In FIG. 14, wall 60 circumscribes the space 73 which receives volute housing 45. Housing 45 is inserted in space 73 by pressing the distal tip of snap 49 through opening 66; the distal tip of snap 50 through opening 65; the distal tip of snap 46 through opening 64; the distal tip of snap 47 through opening 63; and, the distal tip of snap 48 through opening 62. Housing 45 is inserted in space 73 after impeller 36 is inserted by sliding shaft 43 upwardly through opening 68 and aperture 69. The relationship of impeller 36, housing 45, and base 57 after assembly is shown in FIG. 20. After housing 45 is inserted in space 73, wall 52 (FIG. 6 and 7) is inside and adjacent wall 74 (FIG. 13).

Figure 15:
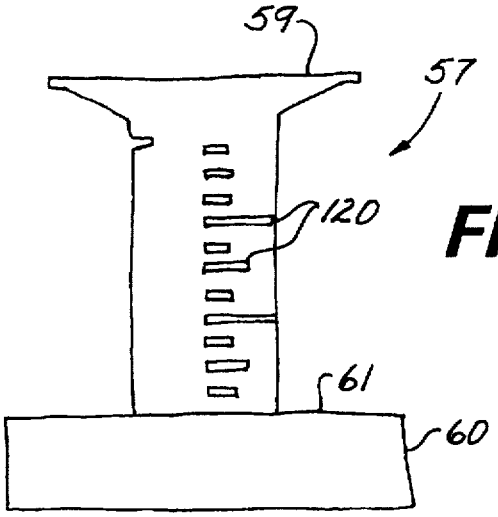
FIG. 15 is a side view illustrating the pump body of FIG. 11.

As indicated by dashed line 56A in FIG. 14, after housing 45 is inserted in base 57, the ramp 56 of housing 45 is positioned to direct in arcuate opening 67 water pumped through outlet 51A by impeller 36. In FIG. 20, the drive shaft 91 from a motor is secured in aperture 44 such that when shaft 91 rotates, shaft 43 and impeller 36 also rotate simultaneously with shaft 91. Pliable rubber or elastic seal 100 prevents water from moving upwardly away from impeller plate 41 through aperture 69. The positioning of impeller 36 beneath the water line 101 in the sump of an evaporative cooler is also illustrated in FIG. 20, as is the extension of plastic control shaft 43 above the water line 101 to prevent the metal drive shaft 91 from contacting the water in the sump. In FIG. 15, base 57 includes molded inscriptions 120 which are used to determine the water level in the pan of an evaporative cooler.

Figure 16:
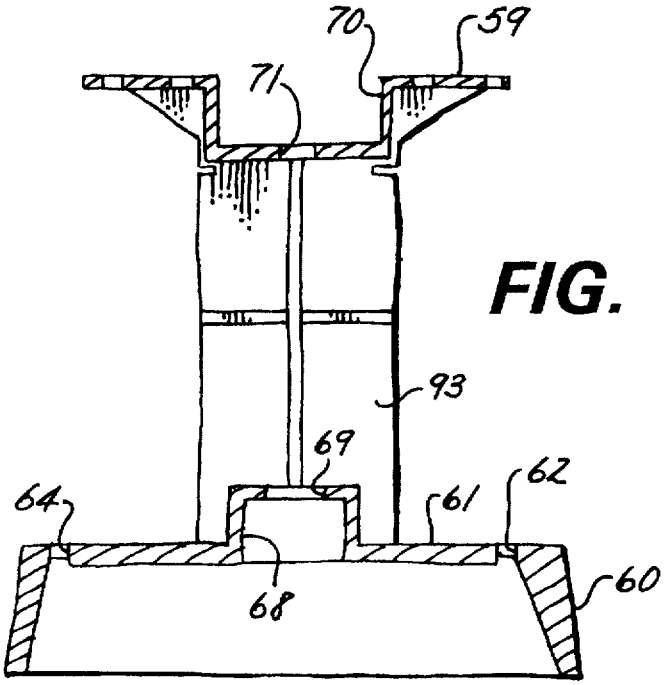
FIG. 16 is a section view illustrating the pump body of FIG. 11 taken along section lines 16—16 thereof.
Figure 17:
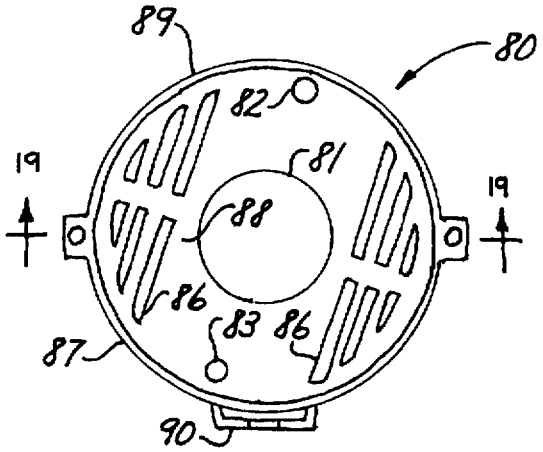
FIG. 17 is a top view illustrating the motor housing or "pump can" which is mounted on the pump body of FIG. 11.
Figure 18:
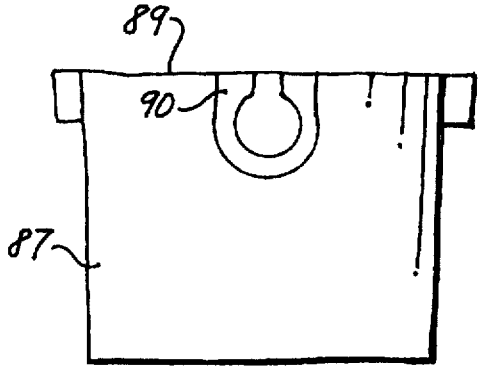
FIG. 18 is a side elevation view illustrating the motor housing or pump can of FIG. 18.

In FIG. 16, the motor is attached to the top of wing 59 such that shaft 91 extends downwardly through apertures 71 and 72 of the tower attached to top 61. Before the motor is attached to the top of wing 59, the "can" or housing 80 illustrated in FIGS. 17 to 19 is secured to wing 59 by aligning apertures 82 and 84 and extending a first bolt or other fastener through the aligned apertures. Apertures 83 and 85 are then aligned and a second bolt or other fastener is extended through the aligned apertures to secure housing 80 in place. The motor is then secured inside the housing 80. If desired, the motor can be secured inside housing 80 before housing 80 is attached to wing 59.

Figure 21:
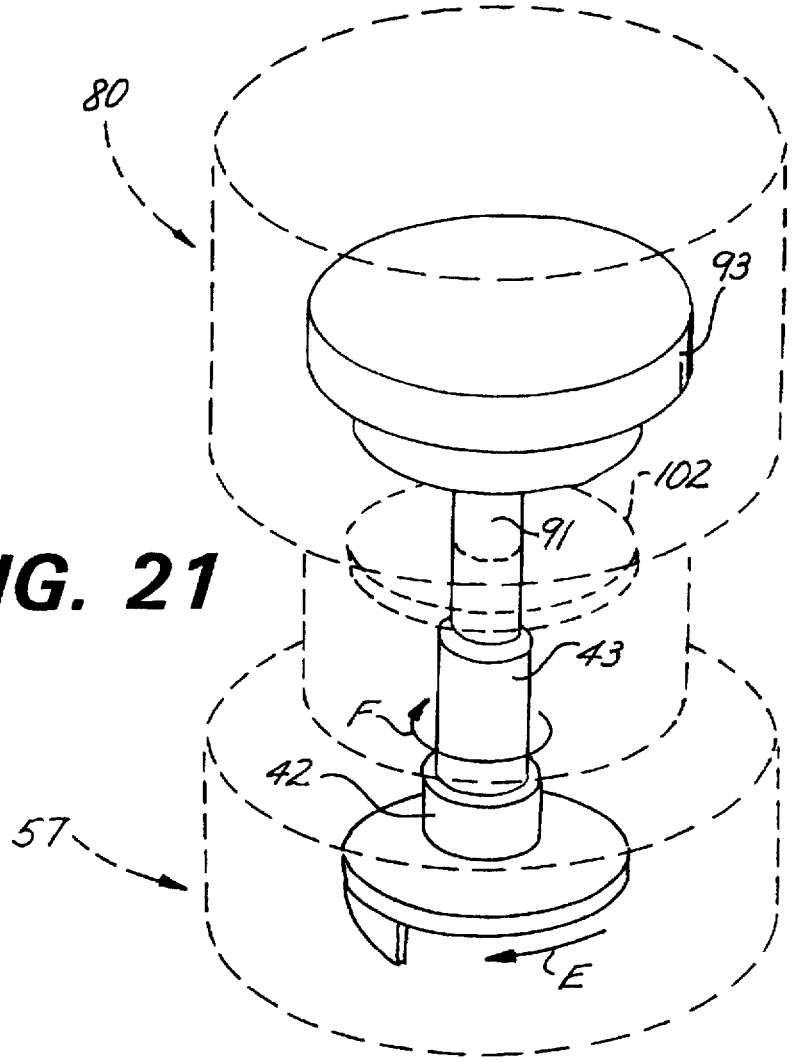
FIG. 21 is a perspective view illustrating the general position of the pump can 80, pump body 57, pump motor 93, and pump impeller 36 after the same are assembled.

The motor housing or "pump can" 80 includes outer cylindrical wall 87 and circular floor 88 with ventilation slots 86 formed therethrough. If desired, a cap or cover can be secured to lip 89 to cover a motor 93 which is positioned within wall 87 of the motor housing 80. The drive shaft 91 of the motor extends through aperture 81 formed through floor 88. Wall 90 is attached to and spaced away from wall 87. As shown by dashed line 102 in FIG. 21, a circular fan member is attached to drive shaft 91 to force air against motor 93 to cool motor 93.

The pump of the invention is readily adapted to accept different sized impellers 36. If, for example, an impeller 36 having a blade with a smaller diameter 103 (FIG. 3) is desired, then a housing 45 is provided which has the same shape and dimension equal to that of the housing in FIG. 5, except that width, indicated by arrow A, and shape and dimension of volute 51 is altered, i.e., is reduced in size, to conform to the smaller size impeller blade. Consequently, the housing 45 for the smaller impeller blade can be readily snapped into place inside base 57 as soon as the old housing 45 and old larger impeller are removed from base 57 and the new smaller impeller is inserted in base 57. While the new smaller impeller has a smaller diameter, the shape and dimension of hub 42 and of control shaft 43 are the same as the shape and dimension of hub 42 and shaft 43 on the old larger diameter impeller 36. Consequently, the hub 42 and control shaft 43 of the new smaller impeller fit the existing apertures 68 and 69 in the same manner as did the hub 42 and shaft 43 of the old, larger, impeller which is replaced by the new smaller impeller.

The size of the impeller 36 can also be varied by altering the height, indicated by arrows F in FIG. 4, of each volute rib or blade 37 to 40 of the impeller. When the height F is altered, then the height, indicated by arrows G, of the volute wall 51 is altered correspondingly. For example, if the height F of each volute blade 37 to 40 is reduced, then the height G of volute wall 51 is reduced. The height G of wall 51 is presently preferably reduced by making bottom wall 55A thicker such that surface 55 is raised to a position which is closer to edge 52A of wall 52. When the elevation of surface 55 is increased in this fashion, the overall height from the bottom of wall 55A to the edge 52A, indicated by arrows H in FIG. 8, remains the same, regardless of variations in the distance indicated by arrows G. When the height F of each volute blade 37 to 40 is altered, the shape and dimension of hub 42 and of control shaft 43 preferably remain the same. Consequently, the hub 42 and control shaft 43 of a new impeller with a smaller height H fit the existing apertures 68 and 69 in the same manner as do the hub 42 and shaft 43 of another impeller with a different height H.

FIG. 20 illustrates the relationship between the impeller 36, pump body or base 57, and pump volute housing 45 when the pump of the invention is assembled. FIG. 20 also illustrates the sealing system used to minimize the flow of water from housing 45 upwardly through aperture 69. This sealing system includes cylindrical washers 100, 114, and 116. If desired, washer 114 can be omitted from the sealing system.

Washer 100 has an aperture 100A with a diameter which is about 0.001 to 0.003 inch greater than the outside diameter of shaft 43. A light substantially rigid plastic is presently utilized to fabricate washer 100. Washer 100 is free to turn inside cylindrical aperture 68 and, since washer 100 is not connected to shaft 43, produces only a very minimal drag on shaft 43. When the impeller is turning, pressure generated in housing 45 forces washer 10 upwardly against surface 68A such that water can escape upwardly from housing 45 only through the small space intermediate aperture 1OOA and shaft 43 and then up through aperture 69. Water escaping upwardly through aperture 69 is deflected laterally away from shaft 43 by washers 111 and 116.

Washer 114, like washer 100 is presently preferably fabricated from substantially rigid plastic. The diameter of cylindrical opening 115 of washer 114 is about 0.001 to 0.003 inch greater than the outside diameter of shaft 43 so that washer 114 does not produce drag on shaft 43. In FIG. 20, washer 114 can turn freely and can move in directions parallel to the longitudinal axis of shaft 43. If desired, however, washer 114 can be fixed in place by being attached to surface 59A or to some other surface.

Washer 116 is an elastomeric rubber washer having a cylindrical aperture 116A which is sized to frictionally fit and engage shaft 43 such that washer 43 rotates simultaneously with shaft 43.

If desired, in FIG. 20, washer 114 can be removed and washer 116 moved closer to circular surface 59A to better laterally deflect water traveling upwardly through aperture 69 toward washer 116.

Impeller 36 is presently fabricated from polypropylene. In FIG. 20, cylindrical aperture 117 of impeller 36 has an inner diameter which is 0.003 to 0.020 inch, preferably 0.005 to 0.015 inch, less than the outer diameter of the end of shaft 43. Shaft 43 presently has a smooth outer surface and has a uniform outer diameter. Impeller 36 is mounted by press or force fitting cylindrical aperture 117 over the cylindrical end of shaft 43 to the position illustrated in FIG. 20. Prior art evaporative cooler pump assemblies require that the lower end of shaft 43 be knurled or that impeller 36 be secured to shaft 43 with a set screw or other means. Press fitting the impeller 36 on shaft 43 in accordance with the invention significantly reduces manufacturing costs.

In the embodiment of the invention illustrated in FIGS. 22 and 23, panel 90 and the portion of wall 87 behind panel 90 have been replaced with outwardly extending wall 105, ledge 108, and U-shaped aperture 109. Ledge 108 extends outwardly from wall 87 and is connected to the bottom of wall 105. Aperture 106 is formed through wall 105 and ledge 108. Aperture 107 is formed through wall 87. U-shaped aperture 111 is formed in the upper edge of wall 105. Elongate tooth 118 extends over the distance indicated by arrow E in FIG. 23 and is generally parallel to edge 112A. Wall 105, ledge 108, U-shaped aperture 109, aperture 106, aperture 107, tooth 118, and aperture 111 collectively form a cord set structure which can be use to accept and anchor any shape of electrical cord which is attached to a motor mounted in the motor housing or can 80.

In use of the cord set of FIGS. 22 and 23, the power cord 110 (FIG. 22) from a motor inside housing 80 is positioned over ledge 108 and extends out from within housing over tooth 118 and through aperture 109 in the manner indicated in FIG. 22. One tie down 112 (FIG. 23) extends through apertures 106 and 111 and around a cord 110 on ledge 108 and is tied to secure cord 110 against ledge 108 and tooth 118. Tie down 112A can also secure cord 110 against the inside of wall 87. Another tie down 112B can be inserted through aperture 107 and around cord 110 to secure cord 110 in position against ledge 108 and through opening 109. The embodiment of the invention illustrated in FIGS. 22 and 23 can be utilized to secure a flat two-wire cord, a flat three-wire power cord, or a circular three wire cord which extends from the motor 93 in housing 80.

Having described my invention in such terms as to enable those skilled in the art to understand and practice it, and having identified the presently preferred embodiments thereof, I claim:

1. A water pump for an evaporative cooler including a sump, said pump including (a) a hollow base including a side wall;

(b) a first impeller volute housing including a volute outlet and a volute wall (51);

(c) a second impeller volute housing including a volute outlet and a volute wall (51), said second volute housing being larger than said first volute housing, said first and second housings each being shaped and dimensioned to be removably mounted inside said base, said volute wall of said first housing being circumscribed by and spaced away from said side wall when said first housing is mounted in said base, said volute wall of said second housing being circumscribed by and spaced away from said side wall when said second housing is mounted in said base, said housing each being interchangeable with the other of said housing on said base and when mounted on said base being normally submerged in water in the sump of the evaporative cooler when mounted in said base, said volute wall of said first impeller volute housing having a shape and dimension different from that of said volute wall of said second impeller housing;

(d) a first impeller having a height and sized to fit inside and be circumscribed and enclosed by said volute wall of said first housing and including a first drive shaft extending out of said first housing, said impeller including arcuate volute blades;

(e) a second impeller having a height and sized to fit inside said second housing and be circumscribed and enclosed by said volute wall of said second housing and including a second drive shaft extending upwardly out of said second housing, said second impeller including arcuate volute blades, said second impeller being larger than said first impeller, said first and second impellers each being shaped and dimensioned to be mounted on said base and being interchangeable with the other of said impellers on said base;

(f) a motor mounted on said base spaced apart from said impeller adapted to connect to and turn (i) said first drive shaft when said first impeller is mounted on said base, and (ii) said second drive shaft when said second impeller is mounted on said base.

2. The pump of claim 1 wherein (a) said wall of said first volute has a spiral shape such that the radius of said wall of said first volute varies along the length of said wall of said first volute; and, (b) said wall of said second volute has a spiral shape such that the radius of said wall of said second volute varies along the length of said wall of said first volute.

3. The pump of claim 1 wherein the height of said first volute is less than the height of said second volute.

4. The pump of claim 1 wherein the width of said first volute is less than the width of said second volute.

5. The pump of claim 1 wherein (a) said first volute and said second volute each include an edge (52A) and a surface (55) spaced apart from said edge (52A); and, (b) the distance between said edge (52A) and said surface (55) is less in said second volute than in said first volute.

6. The water pump of claim 1 wherein (a) said volute wall of said first impeller volute housing has a height at least substantially equal to the height of said first impeller and, when said first impeller is fit in said first impeller volute housing, said volute wall of said first impeller volute extends through substantially the entire height of said first impeller; and, (b) said volute wall of said second impeller volute housing has a height at least substantially equal to the height of said second impeller and, when said second impeller is fit in said second impeller volute housing, said volute wall of said second impeller volute extends through substantially the entire height of said second impeller.

7. A water pump for an evaporative cooler including a sump, said pump including (a) a hollow base including a volute shaped wall (74);

(b) a first impeller volute housing including a volute outlet, a volute wall (51), and an arcuate side wall (52);

(c) a second impeller volute housing including a volute outlet, a volute wall (51), and an arcuate side wall (52), said volute wall of said first volute housing having a width less than that of said volute wall of said second volute housing, said arcuate side wall (52) of said first volute housing having a shape and dimension equal to that of said arcuate side wall (52) of said second volute housing, said first and second housings each being shaped and dimensioned to be removably mounted inside said base, said arcuate side wall (52) of each of said first and second volute housings being inside and adjacent said volute shaped wall (74) of said base when either of said volute housings is mounted on said base, said volute housing each being interchangeable with the other of said housings on said base and being normally submerged in water in the sump of the evaporative cooler when mounted in said base, said volute wall of said first impeller volute housing having a shape and dimension different from that of said volute wall of said second impeller housing;

(d) a first impeller having a height and sized to fit within and be enclosed and circumscribed by said volute wall (51) of said first housing and including a first drive shaft extending out of said housing, said impeller including arcuate volute blades;

(e) a second impeller having a height and sized to fit within and be enclosed and circumscribed by said volute wall (51) of said second housing and including a second drive shaft extending upwardly out of said second housing, said second impeller including arcuate volute blades and having a width greater than that of said first impeller, said first and second impellers each being shaped and dimensioned to be mounted on said base and being interchangeable with the other of said impellers on said base; and, (f) a motor mounted on said base spaced apart from said impeller adapted to connect to and turn (i) said first drive shaft when said first impeller is mounted on said base, and (ii) said second drive shaft when said second impeller is mounted on said base.

8. The water pump of claim 7 wherein (a) said volute wall of said first impeller volute housing has a height at least substantially equal to the height of said first impeller and, when said first impeller is fit in said first impeller volute housing, said volute wall of said first impeller volute extends through substantially the entire height of said first impeller; and, (b) said volute wall of said second impeller volute housing has a height at least substantially equal to the height of said second impeller and, when said second impeller is fit in said second impeller volute housing, said volute wall of said second impeller volute extends through substantially the entire height of said second impeller.

9. A water pump for an evaporative cooler including a sump, said pump including (a) a hollow base including a volute shaped wall (74);

(b) a first impeller volute housing including a volute outlet, a volute wall (51), and an arcuate side wall (52) spaced apart from said volute wall (51);

(c) a second impeller volute housing including a volute outlet, a volute wall (51), and an arcuate side wall (52) spaced apart from said volute wall (51) of said second impeller volute housing, said volute wall of said first volute housing having a width less than that of said volute wall of said second volute housing, said arcuate side wall (52) of said first volute housing having a shape and dimension equal to that of said arcuate side wall (52) of said second volute housing, said first and second housings each being shaped and dimensioned to be removably mounted inside said base, said arcuate side wall (52) of each of said first and second volute housings being adjacent said volute shaped wall (74) of said base when either of said volute housings is mounted on said base, said volute housing each being interchangeable with the other of said housings on said base and being normally submerged in water in the sump of the evaporative cooler when mounted in said base;

(d) a first impeller having a height and sized to fit within said volute wall (51) of said first housing and including a first drive shaft extending out of said housing, said impeller including arcuate volute blades;

(e) a second impeller having a height and sized to fit within said volute wall (51) of said second housing and including a second drive shaft extending upwardly out of said second housing, said second impeller including arcuate volute blades and having a width greater than that of said first impeller, said first and second impellers each being shaped and dimensioned to be mounted on said base and being interchangeable with the other of said impellers on said base; and, (f) a motor mounted on said base spaced apart from said impeller adapted to connect to and turn (i) said first drive shaft when said first impeller is mounted on said base, and (ii) said second drive shaft when said second impeller is mounted on said base.

10. The water pump of claim 9 wherein (a) said first impeller is sized to be enclosed and circumscribed by said volute wall of said first impeller volute housing;

(b) said second impeller is sized to be enclosed and circumscribed by said volute wall of said second impeller volute housing;

(c) said volute wall of said first impeller volute housing has a height at least substantially equal to the height of said first impeller and, when said first impeller is fit in said first impeller volute housing, said volute wall of said first impeller volute extends through substantially the entire height of said first impeller; and, (d) said volute wall of said second impeller volute housing has a height at least substantially equal to the height of said second impeller and, when said second impeller is fit in said second impeller volute housing, said volute wall of said second impeller volute extends through substantially the entire height of said second impeller.

11. The water pump of claim 10 wherein said arcuate side wall (52) of each of said first and second volute housings is inside said volute shaped wall (74) of said base when either of said volute housings is mounted on said base.

12. A water pump for an evaporative cooler including a sump, said pump including (a) a base;

(b) an impeller volute housing in said base and including a volute outlet;

(c) an impeller mounted on said base inside said housing and including a drive shaft extending out of said housing and through an aperture in said base, said impeller including blades, said impeller normally submerged in water in the sump of the evaporative cooler, said drive shaft having a longitudinal axis;

(d) a motor mounted on said base spaced apart from said impeller operatively associated with said drive shaft to turn said drive shaft and impeller;

(e) a first washer inside said base on one side of said aperture in said base and intermediate said impeller and said aperture in said base, said washer circumscribing and spaced apart from said drive shaft and being free to rotate about and move along said drive shaft in directions parallel to said longitudinal axis of said drive shaft; and (f) a second washer (116) on said drive shaft on the other said of said aperture to deflect laterally water traveling out said aperture and away from said impeller toward said second washer.

* * * * *